US010099337B2

(12) United States Patent
Goerges

(10) Patent No.: US 10,099,337 B2
(45) Date of Patent: Oct. 16, 2018

(54) TOOLS FOR LENS PROCESSING

(71) Applicant: James Gregory Goerges, East Gull Lake, MN (US)

(72) Inventor: James Gregory Goerges, East Gull Lake, MN (US)

( * ) Notice: Subject to any disclaimer, the term of this patent is extended or adjusted under 35 U.S.C. 154(b) by 11 days.

(21) Appl. No.: 15/256,700

(22) Filed: Sep. 5, 2016

(65) Prior Publication Data

US 2017/0129068 A1 May 11, 2017

Related U.S. Application Data

(62) Division of application No. 14/037,369, filed on Sep. 26, 2013, now Pat. No. 9,446,495.

(51) Int. Cl.

| | |
|---|---|
| ***B24B 31/02*** | (2006.01) |
| ***B24B 49/00*** | (2012.01) |
| ***B24B 13/005*** | (2006.01) |
| ***B24B 13/02*** | (2006.01) |

(52) U.S. Cl.

CPC ..... *B24B 13/02* (2013.01); *B24B 13/0055* (2013.01); *B24B 13/0057* (2013.01); *B24B 49/00* (2013.01); *Y10T 279/17351* (2015.01)

(58) Field of Classification Search

CPC ... B24B 13/055; B24B 13/0057; B24B 13/02; B24B 49/00

USPC ..... 451/5, 42, 460

See application file for complete search history.

(56) References Cited

U.S. PATENT DOCUMENTS

| | | | | |
|---|---|---|---|---|
| 7,191,030 | B2 | 3/2007 | Videcoq | |
| 7,668,617 | B2 * | 2/2010 | Vassard | G05B 19/401 33/502 |
| 7,970,487 | B2 | 6/2011 | Schaeffer | |

* cited by examiner

*Primary Examiner* — Monica Carter
*Assistant Examiner* — Lauren Beronja
(74) *Attorney, Agent, or Firm* — David George Johnson

(57) ABSTRACT

A lens processing system used for removing a lens blank (98, 110) from an edging block (40). The system includes an elongated collet (22) that engages the mating edging block (40). The block (40) includes an enlarged groove (41) that receives a pair of blades (65, 66) extended upwardly from the floor (75) of the collet (22). Each lens blank (98,110) is formed to include a series of surface markings (191,192) to verify proper functioning of the edging machine that forms a finished lens. Each lens blank also includes a series of circular markings (117,133) arranged in diagonal rows to verify the accurate drilling of bores with the lens blank (98,110).

1 Claim, 19 Drawing Sheets

TOOLS FOR LENS PROCESSING

This patent application is based on Provisional Patent Application No. 61/707,795, filed on Sep. 28, 2012.

BACKGROUND OF THE INVENTION

1. Field of Invention

This invention pertains generally to the field of lens fabrication and more particularly to inspecting and processing a lens during manufacture.

2. Description of Prior Art

The fabrication of lenses includes processing steps to generate both lens surfaces in order to impart specific optical properties to the lens, and also to accomplish the peripheral alteration, or edging, of the lenses. The first step in altering a lens is typically the generation of a surface on a partially finished lens blank. The second step in processing the lens is normally the peripheral alteration of the shape of the surfaced lens. The lens blanks and surfaced lenses may be, for example, spherical, cylindrical, optical flats, aspherical, or of multiple focal lengths. Once the lenses have been finished they may be put to a variety of uses such as spectacle lenses, camera lenses, or lenses used in instrumentation.

Edging the lens to obtain a desired shape involves a series of steps. Typically the optical center and the cylinder axis of the lens is located and marked on a surface. Next the lens is attached to a lens block by some type of holding mechanism, such as an adhesive, so that the optical center and the cylinder axis of the lens are aligned with the center point and cylinder axis of the block. The desired peripheral shape is then imparted to the lens via one or more drilling, cutting, milling, grinding or other machining tools.

Typically the lens cutting and shaping tool is a computer controlled programmable device that may be frequently reprogrammed to manufacture a wide variety of lenses. In order to verify proper programming and operation of the lens forming tool, some means of calibration must be provided.

For example, U.S. Pat. No. 7,191,030, entitled "METHOD FOR ESTIMATING THE ANGULAR OFFSET, METHOD FOR CALIBRATING A GRINDING MACHINE FOR OPTHALMIC GLASSES AND DEVICE FOR CARRYING OUT SAID CALIBRATING METHOD" utilizes a reference standard lens of a predetermined known shape.

U.S. Pat. No. 7,668,617 entitled "METHOD OF CALIBRATING AN OPTHALMIC LENS PIERCING MACHINE, DEVICE USED TO IMPLEMENT ONE SUCH METHOD AND OPTHALMIC LENS MACHINING APPARATUS COMPRISING ONE SUCH DEVICE", uses a template marked with an associated coordinate system. An additional drilling calibration device is used to calculate the difference between the apparent markings on the template and the actual drilling angles needed to create the desired lens.

U.S. Pat. No. 7,970,847 entitled "METHOD OF CALIBRATING AN OPTHALMIC LENS PROCESSING DEVICE, MACHINE PROGRAMMED THEREFOR, AND COMPUTER PROGRAM", presents a scheme for comparing the number of holes actually drilled in a lens with the number of holes predicted according to the programming of a drilling device.

Further, some means must be provided to attach the lens blank to the edging block with a bond that will not fail during alteration but that will permit removal once alteration is complete. In practice, the lens may be removed from the edging block by a variety of methods. For example, the lens may be pried from the block. However, this method has the disadvantage that the lens is often chipped, scratched, or otherwise damaged by the act of prying. This method can be facilitated by immersing the lens and block in hot water for a short period of time. However, some plastic lens materials cannot withstand such temperatures.

Another method of lens removal employs a tab that is pulled in the direction of the plane of the blocking pad so as to cause a reduction in the thickness of the pad and a progressive disengagement of the pad from the interface between lens and block. Removal may also be accomplished by placing the combination of lens, blocking pad and block into a cavity of the mounting block and then rotating the lens and the block in opposite directions with respect to each other, thereby causing them to separate. A specially designed hand tool may also be provided to accomplish this same result. The tool is not as wide as the mounting block and facilitates removal by making it easier to grasp the edge of the lens.

The latter method of lens removal is disclosed in U.S. Pat. No. 3,962,833 entitled METHOD FOR THE ALTERATION OF A LENS AND AN ADHESIVE LENS BLOCKING PAD USED THEREIN, issued to Johnson on Jun. 15, 1976. The problem with the lens removal method disclosed by Johnson is that an operator must manually and repeatedly grasp pliers or a similar tool to remove the lens. Some level of skill is required to perform the lens removal operation rapidly while avoiding damage to the lens. After a period of time in such an occupation, the operator is likely to suffer various forms of fatigue and injury including, for example, carpal tunnel syndrome.

Another method of lens removal utilizes a device that retains the blocked lens by means of a collet chuck or clamp. An example of such a device is disclosed in U.S. Pat. No. 8,182,314 entitled AUTOMATED EDGED LENS DEBLOCKING SYSTEM, issued to Goerges on May 22, 2012. The blocked lens resides on a pad which supports the lens on the edging block while protecting the lens from abrasion or damage from the block itself. A pair of opposed movable lens clamps or arms are pneumatically advanced to grip the blocked lens along portions of the lens edge. Once the lens is secured by the lens clamp, the collet chuck is rotated approximately forty five degrees, thereby breaking the bond between the lens and the edging block. The lens clamps may then be retracted away from the lens edges and the lens may be manually removed from the pad.

A problem with the geometry of the '314 device is that repeated use causes wear on the collet chuck that leads to relatively premature failure, particularly when a hydrophobic adhesive pad is applied to an uncoated lens. Use of the hydrophobic pad requires a substantially greater force for lens removal than other pad/lens combinations, thereby accelerating the wear on both the collet and the edge block.

What is needed is a visually verifiable lens template that permits a wide variety of lens parameters to be immediately inspected after a lens machining tool is programmed to create a specific lens. Any error or anomaly in the lens created, and the nature of the corrective action needed, should be apparent by viewing the lens template without further need of a machine based analysis. Further, the edged lens deblocking device must be capable of repeated industrial scale operation without failure.

SUMMARY OF THE INVENTION

The current invention is an improved apparatus and method for processing a lens that has undergone an edging procedure, including an improved apparatus for the removal of a lens from an edging block and a means for verifying the integrity and accuracy of the edging process performed on the lens. The edged lens is freed from an adhesive pad by the twisting motion of a collet. Periodically the edged lens is a calibration blank which may be inspected for compliance with the desired edging operations.

In a preferred embodiment of the invention, a blocked lens is placed on each collet, the collet being formed to include an elongated cylindrical body that mates with an existing deblocking device such as the type described in the aforementioned U.S. Pat. No. 8,182,314. The collets are formed with a series of circumferential ribs surrounded by a larger circumferential wall that defines a bore. The edging blocks are formed to include a mating groove structure that accepts protrusions formed within the base of the bore. Some of the edging blocks are periodically affixed to a calibration blank having a series of parallel and intersecting lines, as well as circles or portions of circles, the lines and circles permitting rapid visual inspection of the edging or machining processes performed on the lens. These and other advantages of the present invention will become apparent by referring to the accompanying drawings and the detailed description of the invention.

DETAILED DESCRIPTION OF THE PREFERRED EMBODIMENTS

Figure 1:
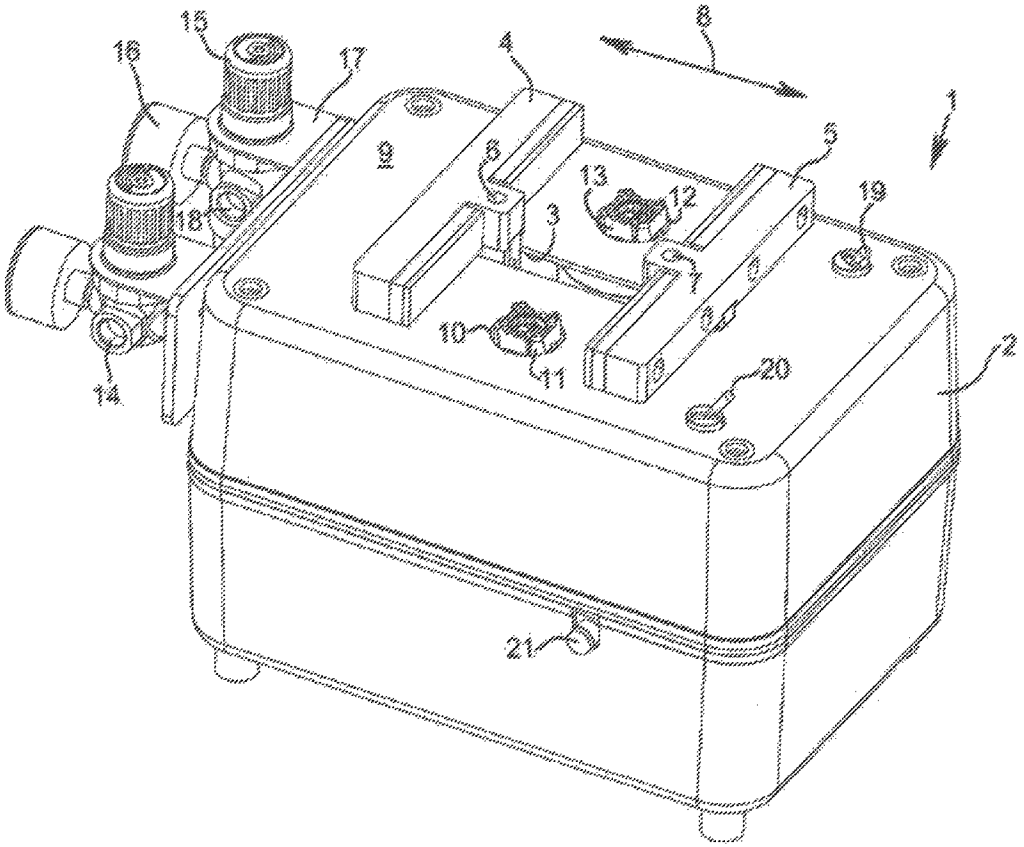
PRIOR ART FIGURE 1
FIG. 1 is a perspective view of a prior art automated edged lens deblocking system.

Referring to FIG. 1, a prior art automated edged lens deblocking device is shown generally at 1. The deblocking device 1 includes a protective cabinet 2 typically composed of a durable metal or plastic material. The top surface 9 of the cabinet 2 is formed to include a generally rectangular aperture or slot 3 above which a pair of opposed arms 4 and 5 are slidably mounted by means of supports 6 and 7. The supports 6 and 7 permit movement of the arms 4 and 5 in the directions generally indicated by arrow 8. The top surface 9 also includes an opening or first circular aperture 10 which permits access to a first collet or edging block clamp 11. A second circular aperture 12 is located in a symmetrical position opposite the rectangular aperture 3. The circular aperture 12 permits access to a second collet or edging block clamp 13.

Figure 6:
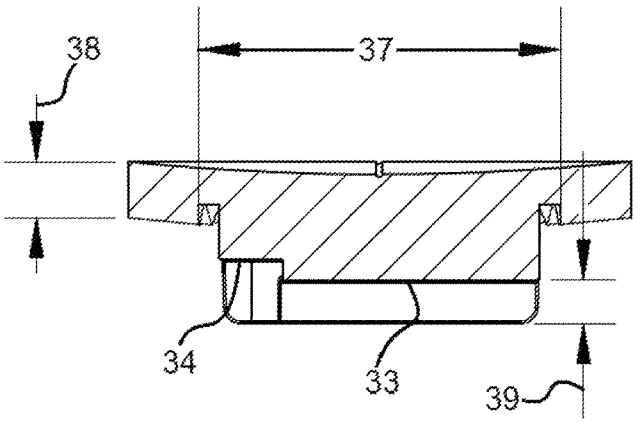
PRIOR ART FIGURE 6
FIG. 6 is a sectional view of the prior art edging block depicted in FIG. 1 taken along line 6-6.
Figure 5:
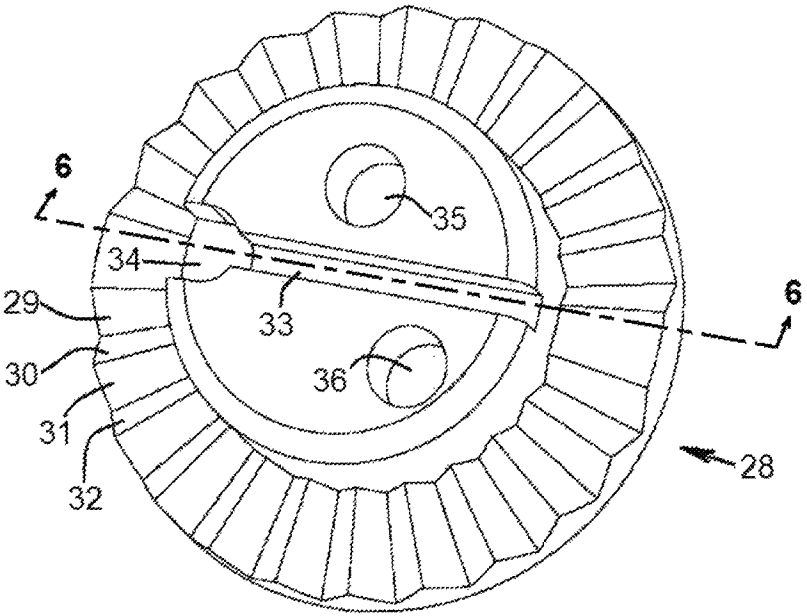
PRIOR ART FIGURE 5
FIG. 5 is a bottom plan view of the prior art edging block depicted in FIG. 4.
Figure 8:
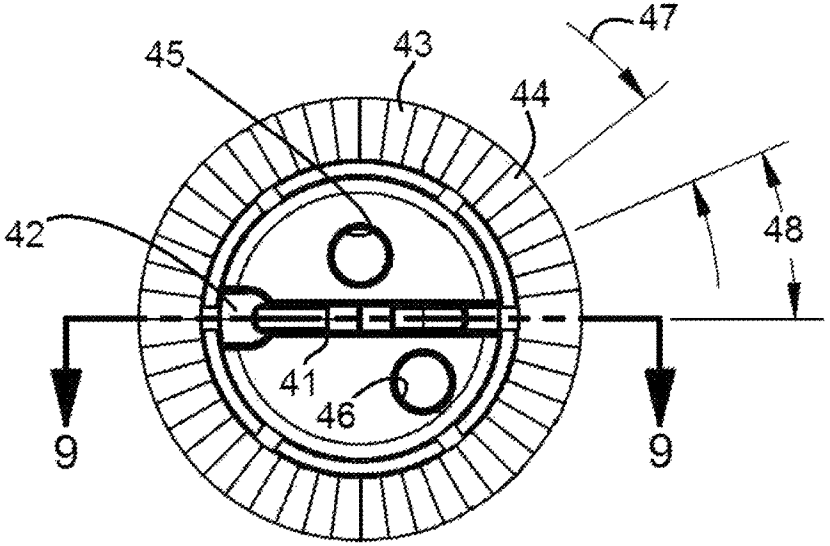
FIG. 8 is a bottom plan view of the edging block depicted in FIG. 7.
Figure 7:
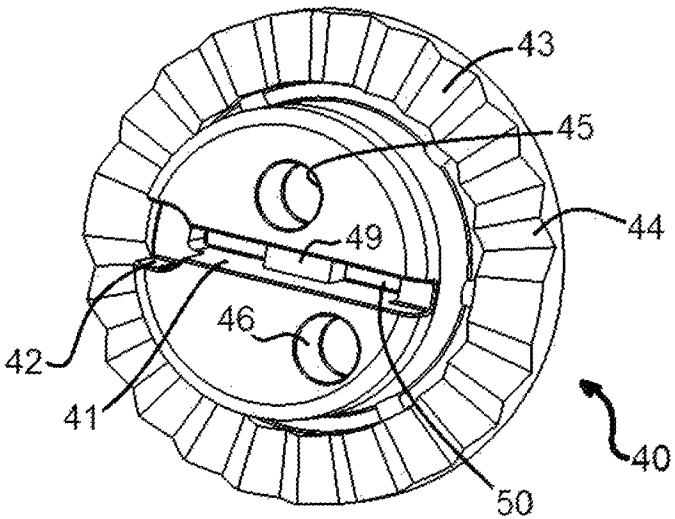
FIG. 7 is a perspective view of an edging block constructed according to the principles of the present invention.
Figure 10:
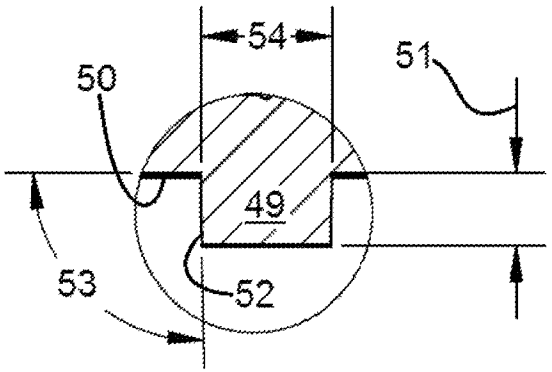
FIG. 10 is a detail view of the edging block depicted in FIG. 9, as indicated by the circle 10.

The edging block clamp 13 is intended to mate with an edging block. As seen in FIGS. 5 and 6, a prior art edging block 28 includes a series of inclined surfaces, such as surfaces 29, 30, 31 and 32, for example. Additionally the block 28 includes a diametric groove 33 which broadens to a keyway 34 at one end. The block 28 also contains a pair of substantially circular indentations 35 and 36. At least some of the features such as the surfaces 29-32, the groove 33, the keyway 34, the indentation 35 and indentation 36 are adapted to mate with and be gripped either by or within an edging block clamp, such as clamp 11, when the block 28 is placed on the clamp 11 and toggle switch 19 is activated. The greatest diameter 37 is typically 0.707 inch with a thickness 38 of 0.110 inch. The depth 39 of the groove 33 is 0.085 inch.

Figures 2, 3:
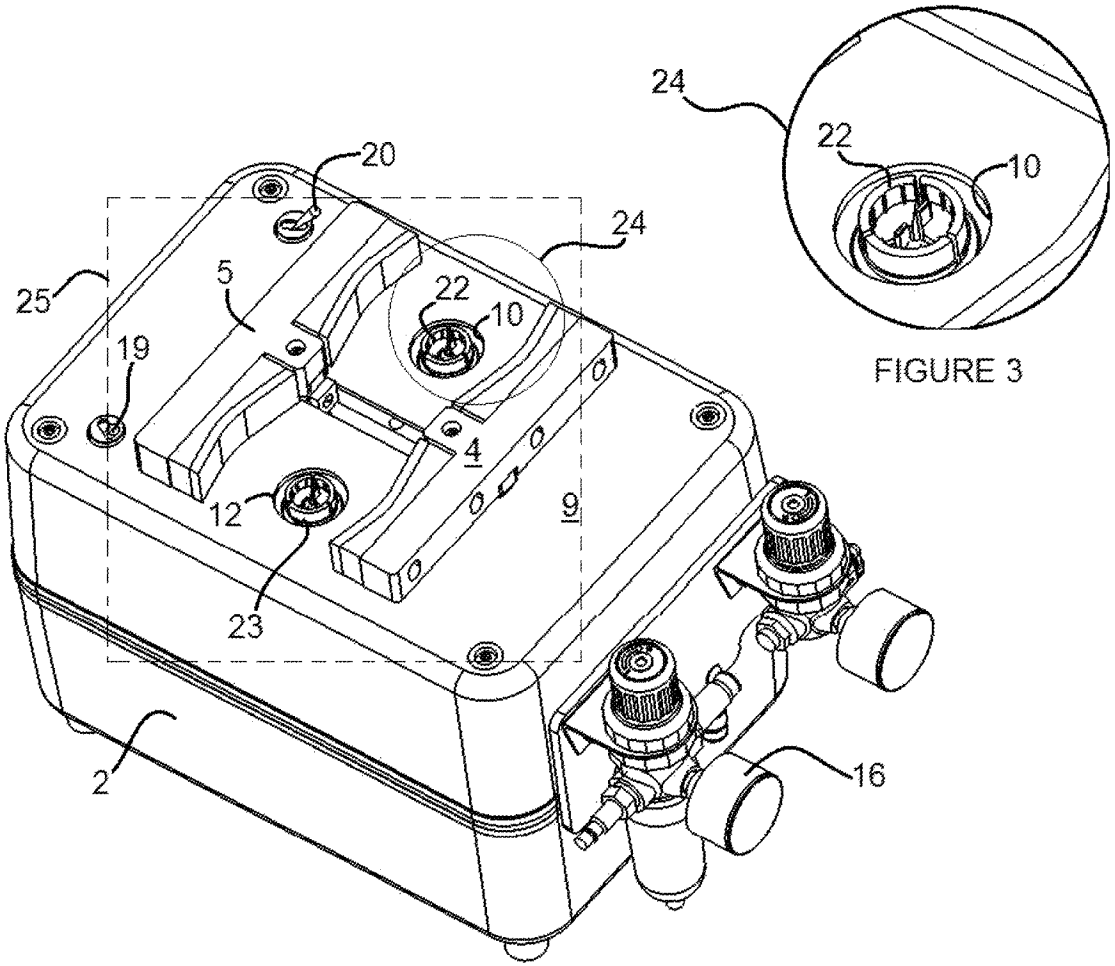
FIG. 2 is a perspective view of an automated edged deblocking system constructed according to the principles of the present invention.
FIG. 3 is a perspective view of detail 24 of the automated edged deblocking system depicted in FIG. 2.
Figure 4:
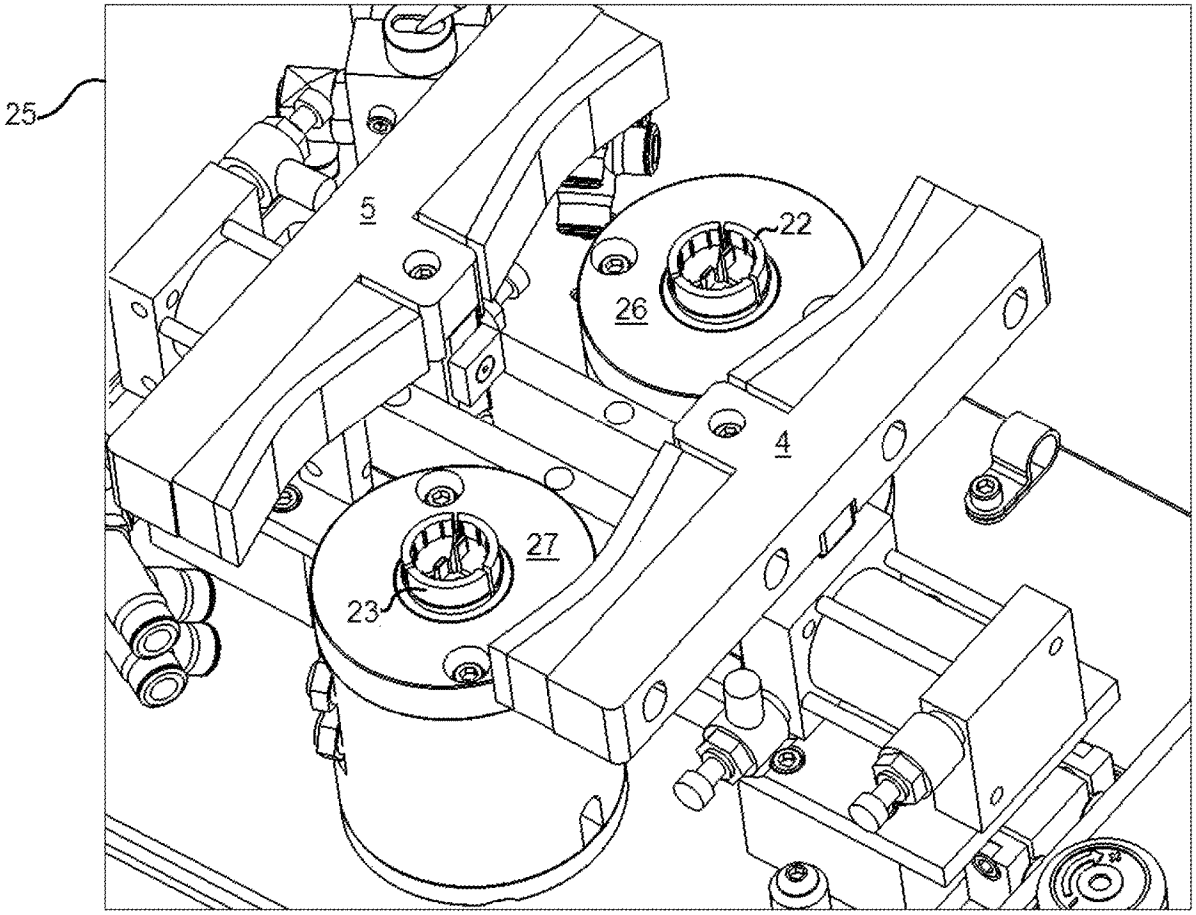
FIG. 4 is a perspective view of the portion of the present invention indicated by rectangle 25 in FIG. 2, with the chassis cover removed.

FIGS. 2, 3 and 4 illustrate the present invention, which includes a first elongated collet 22 and a second elongated collet 23. The first elongated collet 22 extends through the first circular aperture 10, while the second elongated collet 23 extends through the second aperture 23. With the top surface 9 of the cabinet 2 removed, the first elongated collet 22 is seen to be mounted on first collet closer 26. The second elongated collet 23 is mounted on a second collet closer 27.

Figure 9:
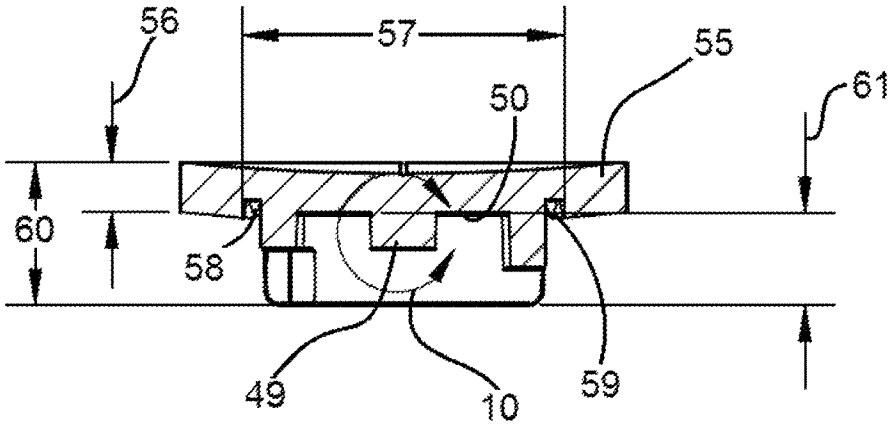
FIG. 9 is a sectional view of the edging block illustrated in FIG. 8, taken along line 9-9.

FIGS. 7, 8, 9 and 10 depict a novel edging block 40 that is intended for use with the elongated collets 22 and 23. The edging block 40 includes a series of inclined surfaces such as surfaces 43 and 44, for example, that are shaped and dimensioned to engage the collet 22. The circumferential space occupied by each surface 43 or 44, for example, is approximately 7.5 degrees, creating an angle 47 of approximately 15 degrees between two adjacent surfaces or an angle 48 of approximately 22.5 degrees between three successive surfaces. The present invention also includes a plurality of circular bores 45 and 46 for engagement with suitable fixtures that may be used to secure the edging block during lens machining operations. The edging block 40 includes a centrally located groove 41 terminating at keyway 42. As best seen in FIG. 9, the groove 41 includes a blade or protrusion 49 extending from the bottom surface 50 of the groove for a distance 51 of approximately 0.080 inch. The angle 53 between the sidewall 52 of blade 49 and the bottom surface 50 is approximately 91 degrees. The length 54 of the blade 49 is approximately 0.145 inch. The outer lip 55 of the edging block 40 has a thickness 56 of approximately 0.110 inch, while the diameter 57 between the opposed inclined surfaces 58 and 59 is approximately 0.707 inch. The overall height 60 of the edging block 40 is approximately 0.316 inch, while the depth 61 of groove 41 is approximately 0.205 inch.

Figure 11:
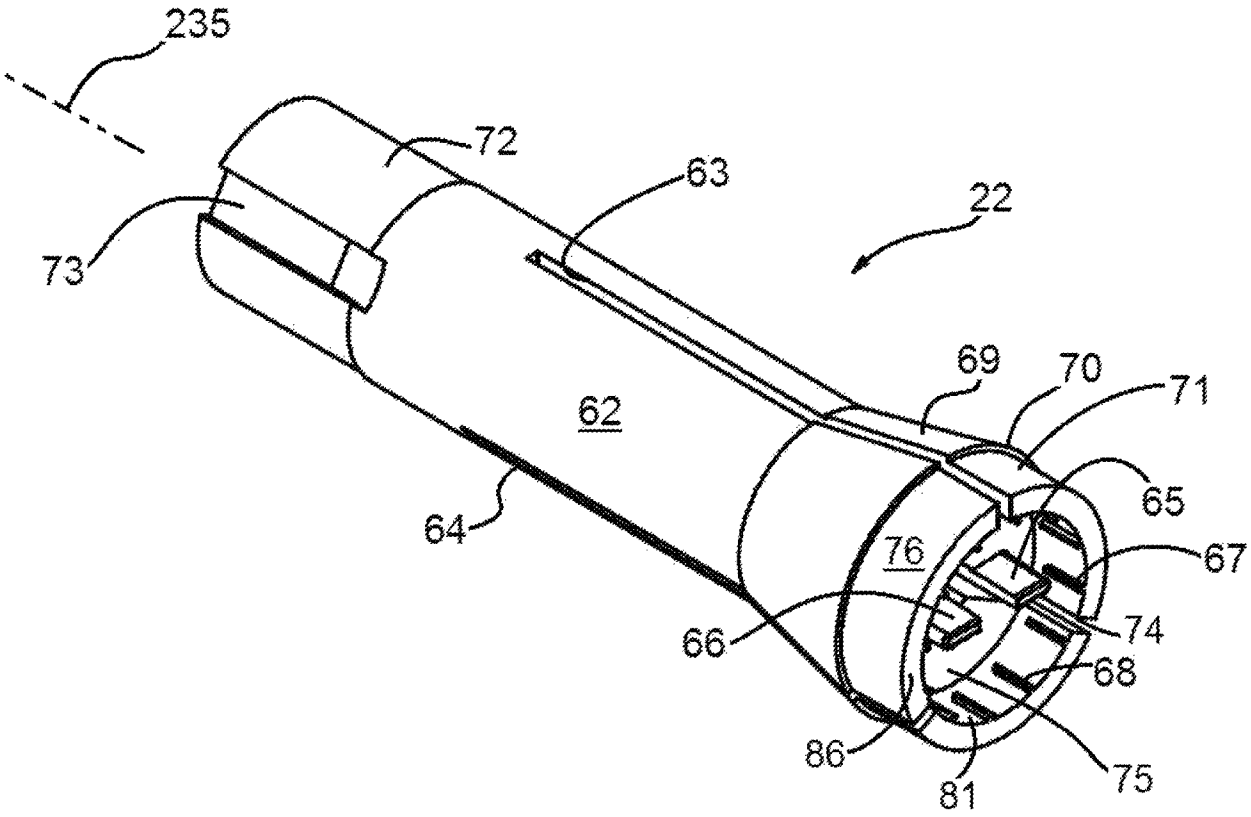
FIG. 11 is a perspective view of a one piece collet constructed according to the principles of the present invention.

The elongated collet 22 that receives the edging block 40 is depicted in greater detail in FIG. 11. The elongated collet 22 is formed to include a generally cylindrical sidewall 62 that is partially separated by three longitudinal slots 63, 64 and 74. Each slot, such as slot 63, extends through a frustoconical transition 69 that terminates at lip 70. Integrally formed with and adjoining the transition 69 is a turret 76 that surrounds a base 75. Also integrally formed with the sidewall 62 is a base 72 which includes at least one keyway 73 that is adapted to mate with a motor, gear, piston or other fixture that can rotate the elongated collet about the longitudinal axis 235. Typically, the base 72 includes threads that are compatible with a receptacle such as a collet closer.

Figure 12:
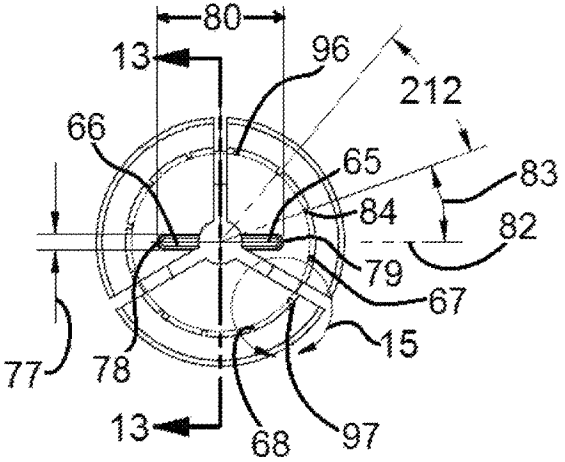
FIG. 12 is a top plan view of the collet depicted in FIG. 11.

Referring also to FIG. 12, a pair of protruding plates or fingers 65 and 66 is seen to extend upwardly from the base 75 of turret 76, the plates being suitably dimensioned to fit within the groove 41 of edging block 40. The thickness 77 of each plate 65 and 66 is approximately 0.060 inch. The distance 80 between the outer end 78 of plate 66 and the outer end 79 of the plate 65 is approximately 0.450 inch. The turret 76 also includes an inner wall 81 and an outer wall 71, the inner wall 81 being formed to include a series of substantially equally spaced columns, such as columns 67 and 68 for example. The columns engage with the edging block surfaces 43 and 44, for example, to add further stability to the edging block 40 when mounted to the turret 76. The angular distance 212 between adjacent columns is approximately thirty degrees. The greatest angular distance 83 between the lateral axis 82 of the plate 65 and the farthest adjacent inner wall column 84 is approximately twenty degrees.

Figure 13:
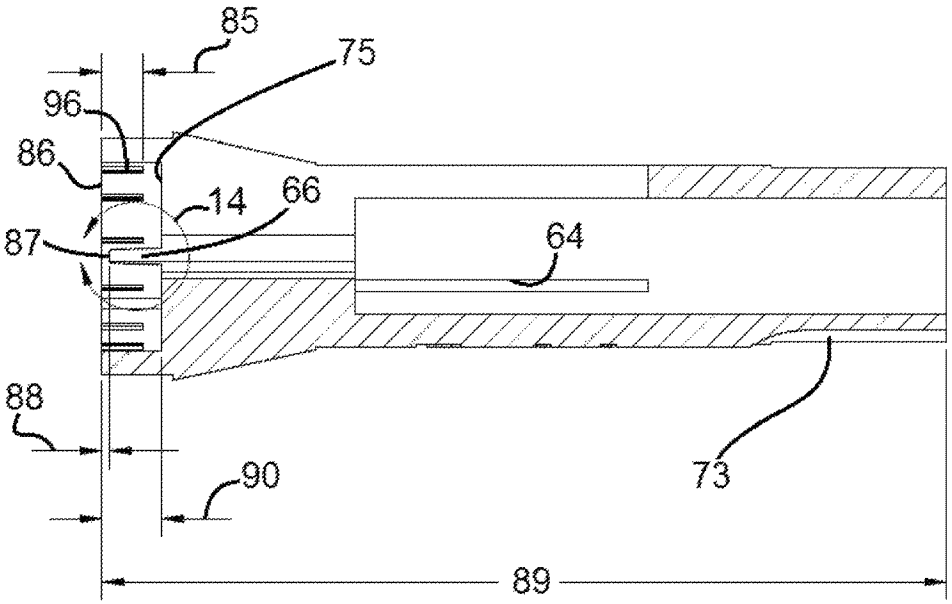
FIG. 13 is a sectional view of the collet depicted in FIG. 12, taken along line 13-13.
Figure 15:
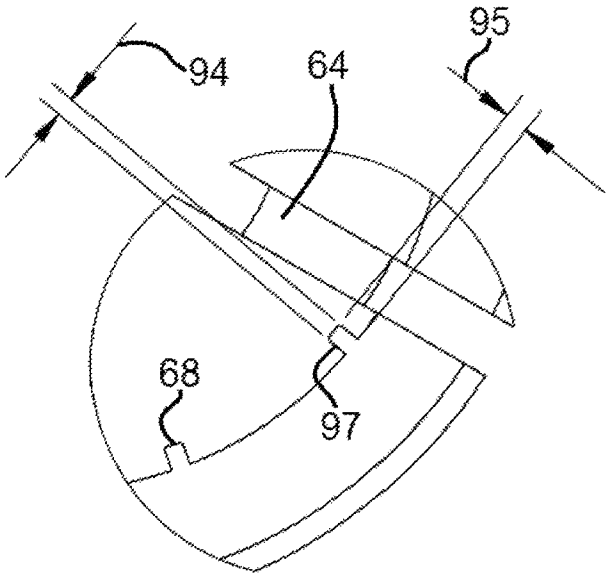
FIG. 15 is a detail view of the collet depicted in FIG. 14, illustrating the region within the circle 15.
Figure 14:
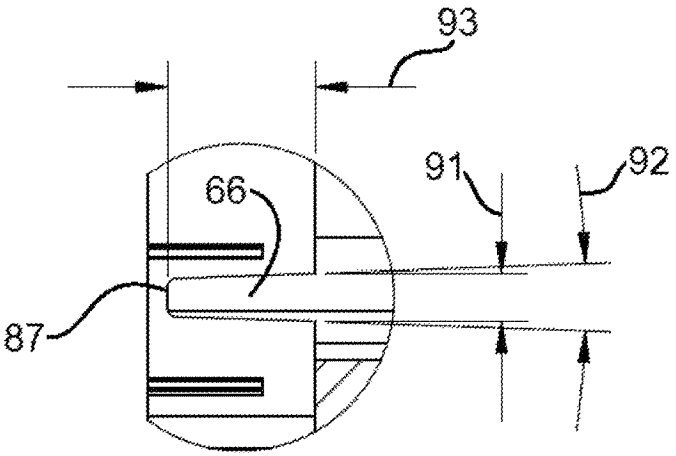
FIG. 14 is a detail view of the collet depicted in FIG. 13, illustrating the region within the circle 14.

As best seen in FIG. 13, the height 85 of each inner wall column, such as column 96, for example is approximately 0.145 inch. The clearance 88 between the top surface 86 of the turret 76 and the top surface 87 of the plate 66 is approximately 0.025 inch. The overall length 89 of the elongated collet 22 is approximately three inches. The distance 90 between the base 75 and the top surface 86 of the turret 76 is approximately 0.210 inch. Referring also to FIGS. 14 and 15, the height 93 of the plate 66 is 0.185 inch. The base width 91 of the plate 66 is approximately 0.060 inch while the plate sidewall taper 92 is approximately four degrees. The cross sectional width 94 of each inner wall column, such as column 97, for example, is approximately 0.016 inch and the height 95 of column 97 is approximately 0.020 inch.

Figure 16:
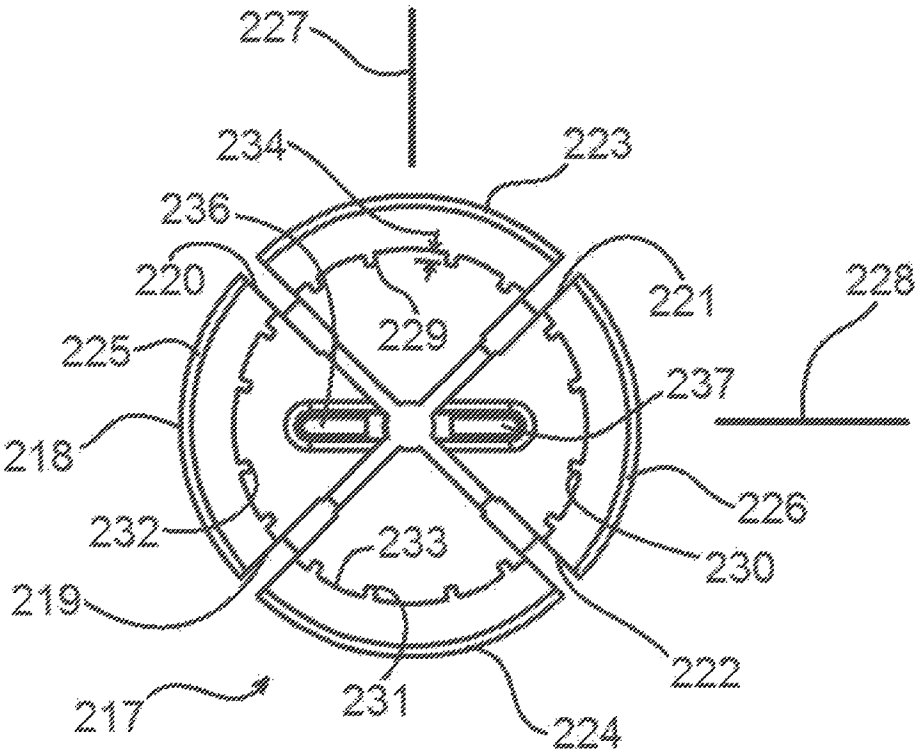
FIG. 16 is a top plan view of a second embodiment of the collet of the present invention.
Figure 20:
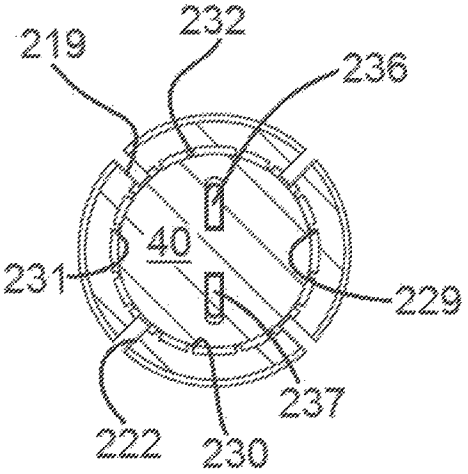
FIG. 20 is a sectional view taken along line 20-20 as shown in FIG. 19.
Figure 19:
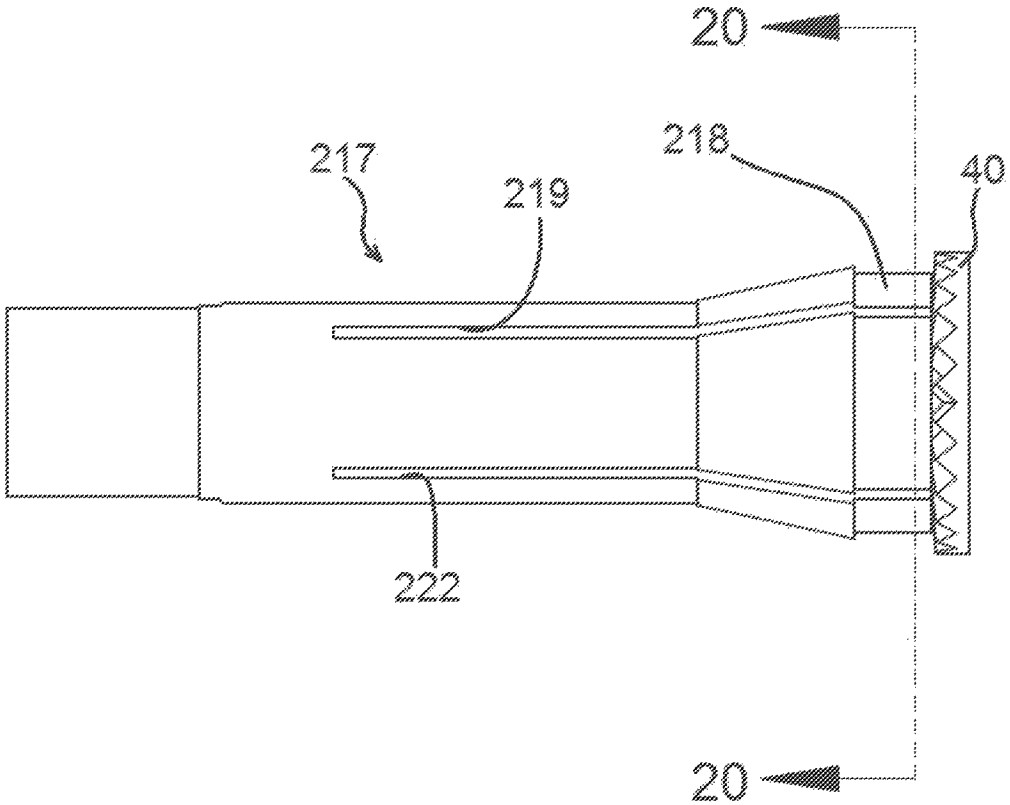
FIG. 19 is a side elevation of the second embodiment of the collet depicted in FIG. 16 shown and the edging block depicted in FIG. 7 combined to create a lens blank manipulation assembly.

FIGS. 16, 19 and 20 depict an alternate embodiment 217 of the elongated collet 22. The turret 218 is formed to include four longitudinal slots 219, 220, 221 and 222. The result is the creation of four individual tangs 223, 224, 225 and 226, the tangs 223 and 224 being deformable in a direction parallel to line 227 while tangs 225 and 226 may be deflected in a direction that is parallel to the line 228. Sixteen individual columns, such as columns 229, 230, 231 and 232 are formed on the inner wall 233 of the turret 218, arranged symmetrically such that four columns each reside on any individual tang 223-226. Each column protrudes outwardly from the inner wall 223 by a distance 234 of approximately 0.044 inch.

The elongated collet 217 includes a pair of upwardly extending blades 236 and 237 adapted to engage the edging block 40. The elongated collet 217 permits the application of a greater force to an edging block 40 inserted into the turret 218, thereby suppressing movement of the edging block with respect to the inner wall 223 during rotation of the elongated collet. Both the elongated collets 22 and 217 are formed of a metallic alloy manufactured by Hardinge, Inc. of Elmira, N.Y. The inner wall 223 may be coated with a diamond film or surface texture in order to further reduce wear caused by differential motion between the collet and the edging block.

Figure 18:
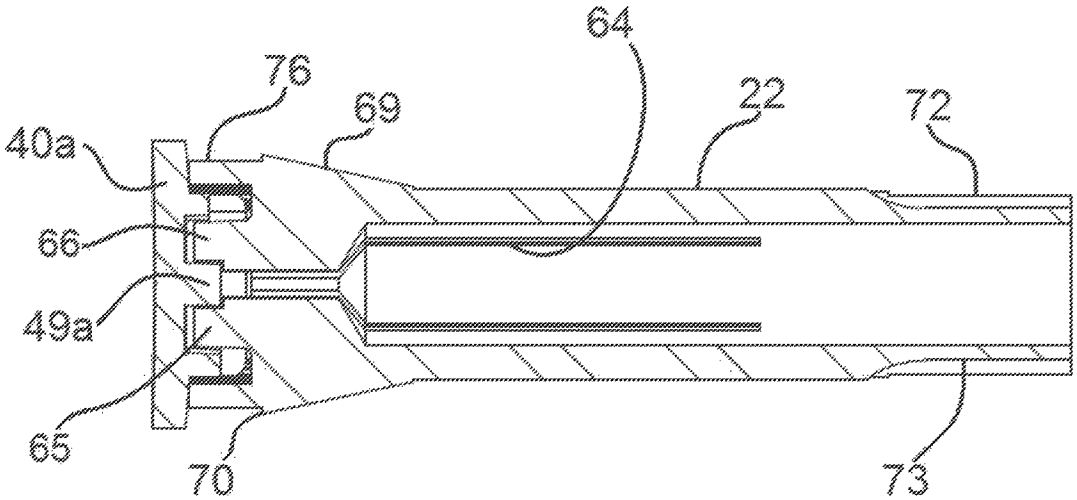
FIG. 18 is a sectional view taken along line 18-18 as shown in FIG. 17.
Figure 17:
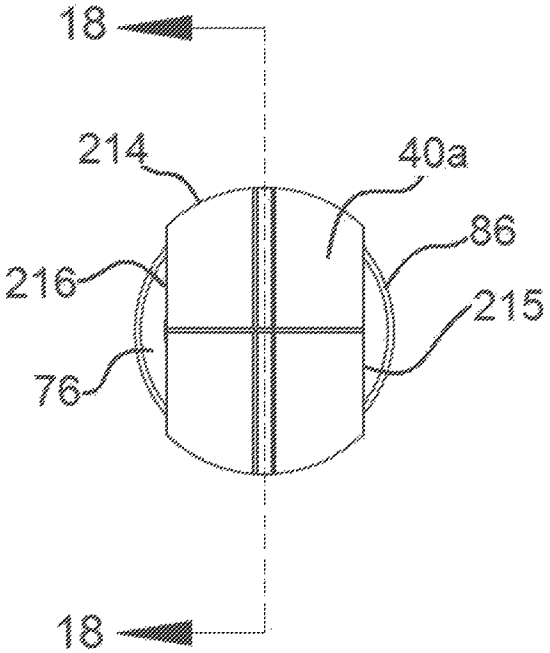
FIG. 17 is a top plan view of the collet of FIG. 11 and an alternate embodiment of an edging block combined to create a lens blank manipulation assembly.

Referring to FIGS. 17 and 18, a modified edging block **40*a* is depicted. The edging block 40*a* is substantially similar to the edging block 40 disclosed in FIG. 7, except that the circular perimeter 214 of the edging block 40*a* is interrupted by the two parallel sidewalls 215 and 216, thereby creating a relatively smaller surface area for the edging block 40*a*. The geometry of the block 40*a* is useful for mounting smaller lenses so as not to interfere with edging tools that may be employed in shaping a smaller lens. The edging block 40*a* is mounted on the turret 76. The central protrusion 49*a* of the edging block 40*a* fits snugly between the blades 65 and 66 of the turret 76** to create a unified assembly capable of resisting a substantial torsional force.

Figure 22:
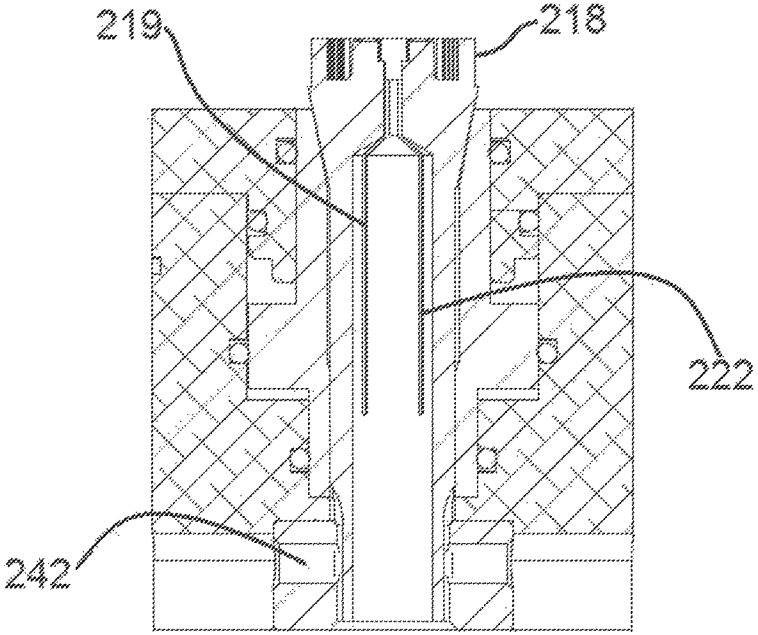
FIG. 22 is a sectional view taken along line 22-22 as seen in FIG. 21.
Figure 21:
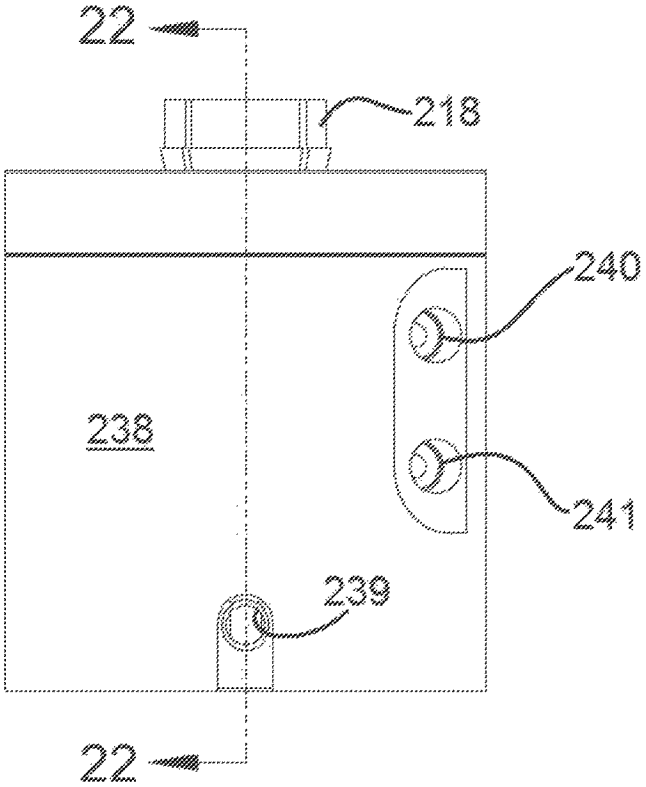
FIG. 21 is a side elevation of a collet closer as used in conjunction with the present invention.

FIGS. 21 and 22 illustrate the collet closer 238 that grips and rotates the elongated collet 217. The collet closer 238 operates generally as disclosed in U.S. Pat. No. 5,221,098 entitled "Collet Closer". The first inlet orifice 240 permits the application of pressure to unclamp the collet 217, while the second inlet orifice 241 permits the application of pressure to clamp the collet 217. The bore 239 permits access to a set screw residing in threaded chamber 242, thereby permitting the collet 217 to be secured within the collet closer 238.

Figure 23:
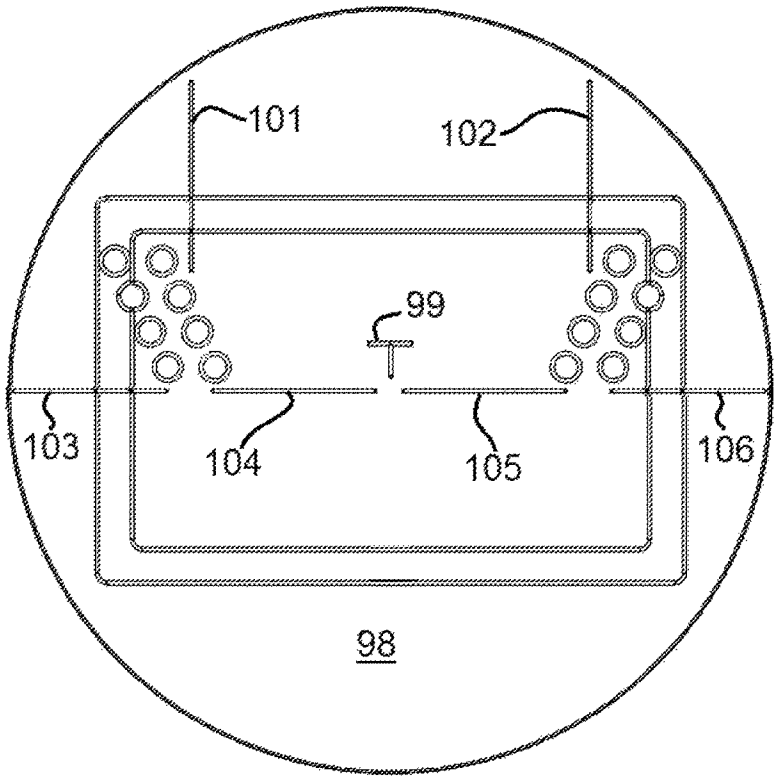
FIG. 23 is a front elevation view of a first embodiment of a calibration lens constructed according to the principles of the present invention.

The calibration lens blank 98 depicted in FIG. 23 is an example of a lens blank that may be manipulated by the combination of the elongated collet 22 and edging block 40. The calibration lens 98 includes a series of calibration markings such as an alignment cross 99, vertical lines 100 and 101, and horizontal lines 102, 103, 104 and 105. A plurality of circles, such as circles 106, 107, 108 and 109, are also formed on the lens blank 98 by means of drawing, etching, engraving, painting or other surface marking techniques. In practice, the line and circle configuration of blank 98 may be varied, but this particular example is illustrative of the basic geometrical features of the present invention.

Figure 24:
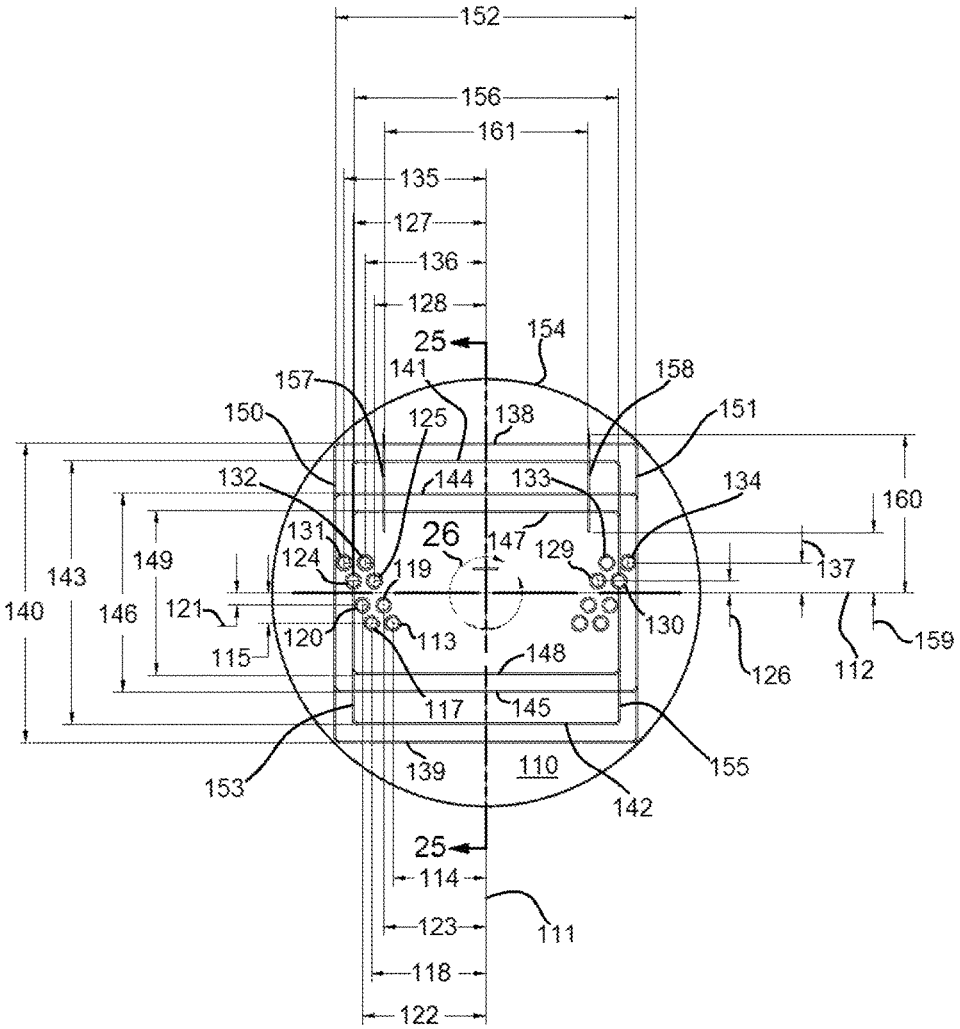
FIG. 24 is a front elevation view of a second embodiment of a calibration lens constructed according to the principles of the present invention, including dimensional information.
Figure 26:
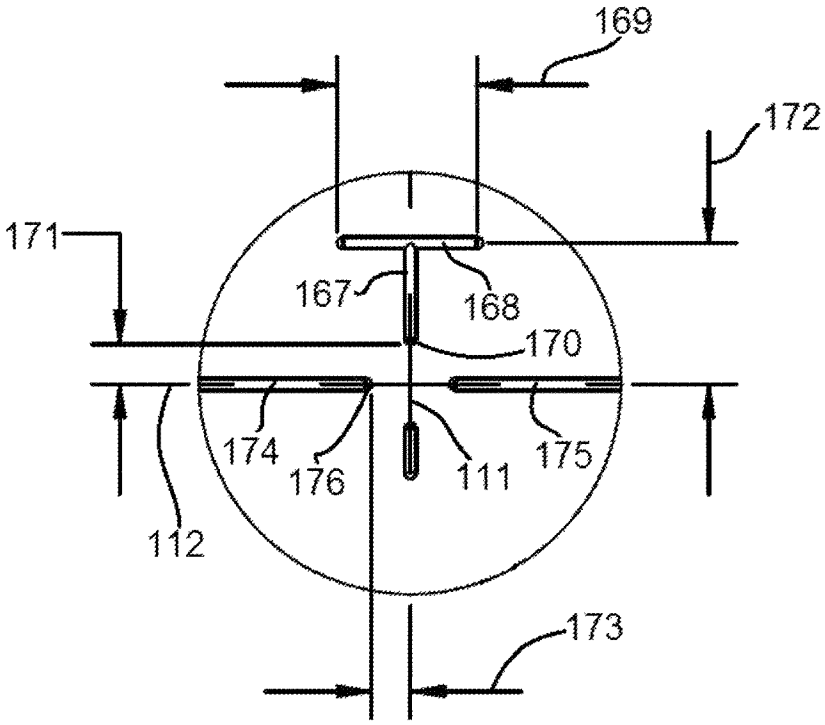
FIG. 26 is a detail view of the calibration lens as illustrated in FIG. 24 within the region 26.
Figure 25:
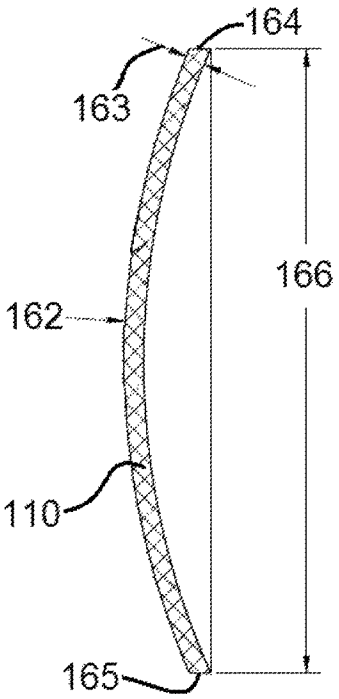
FIG. 25 is a sectional view of the calibration lens illustrated in FIG. 24 taken along the line 25-25.

A second embodiment of a calibration lens blank 110 is illustrated in FIGS. 24, 25 and 26, showing a lens blank having sixteen circular markings arranged in a pattern with respect to a horizontal axis 112 and a vertical axis 111. In practice, the lens blank 110 is manufactured in two forms, both of which are geometrically identical. However, one version is composed of polycarbonate, while the other version is made of allyl diglycol carbonate, a plastic polymer commonly referred to as CR39. The polycarbonate material is more difficult to shape using traditional cutting tools, meaning that a version of lens blank 110 would often require different tool pressure settings when being processed by an automated shaping device. In order to verify the proper operation of a highly automated shaping apparatus, both a polycarbonate and a CR39 lens blank 110 are shaped by the same device in order to determine if the cutting tool is properly adapting to each material to produce a substantially identical lens.

The first circular marking 113 on lens blank 110 is placed at a distance 114 of approximately 0.610 inch from the vertical axis 111 and at distance 115 of approximately 0.198 inch from the horizontal axis 112. The horizontally adjacent second circular marking 117 is spaced at a distance 118 of approximately 0.753 inch from the vertical axis 111. Vertically offset from the circular markings 113 and 117 is a horizontal row composed of circular markings 120 and 119. The innermost marking 119 resides at a distance 121 of approximately 0.079 inch from the horizontal axis 112 and at a distance 123 of approximately 0.753 inch from the vertical axis 111. The outermost marking 120 is placed at a distance 122 of approximately 0.812 inch from the vertical axis 111. The circular markings 113 and 117 define a first horizontal row, while circular markings 119 and 120 define a second horizontal row.

A third horizontal row of circular markings, residing above the horizontal axis 112, is defined by the circular markings 124 and 125. The marking 124 is displaced a distance 126 of approximately 0.079 inch from the horizontal axis 112 and by a distance 127 of approximately 0.871 inch from the vertical axis 111. Ideally, the distances 121 and 126 are substantially equal. The horizontally adjacent circular marking 125 is displaced by a distance 128 of approximately 0.733 inch from the vertical axis 111.

Markings 124, 125, 129 and 130 define a horizontal row that is symmetrically spaced about the vertical axis 111. The markings 124, 125, 129 and 130 indicate that a single type of lens may be fastened on either a right or left side to a spectacle lens frame, for example. This requirement creates the need for calibration marks that are symmetrical about the single vertical axis 111. A fourth horizontal row is composed of circular markings 131, 132, 133 and 134. Circular marking 131 is displaced a distance 135 from the vertical axis 111 by approximately 0.931 inch. The marking 132 is displaced from the vertical axis 111 by a distance 136 of approximately 0.792 inch. Each of the markings 131, 132, 133 and 134 is displaced from the horizontal axis 112 by a distance 137 of approximately 0.198 inch. The circular markings 113, 119, 125 and 132 form one of four diagonal rows appearing on the calibration lens 110. The four rows of circular markings permit four successive uses of the calibration lens 110, moving inwardly from the outermost hole 131 to the innermost hole 113.

The calibrations lens 110 includes four pairs of horizontal linear markings. The first pair of linear markings is composed of lines 138 and 139 which are spaced apart by a distance 140 of approximately 1.969 inch. The second, adjacent pair of linear markings includes lines 141 and 142 which are separated by a distance 143 of approximately 1.732 inch. The third adjacent pair of linear markings consists of horizontal lines 144 and 145, spaced apart by a distance 146 of approximately 1.309 inch. The innermost pair of horizontal linear markings is formed by lines 147 and 148 which are separated by a distance 149 of approximately 1.084 inch. The four pairs of horizontal lines permit the calibration lens 110 to be used four separate times, that is, as material is successively removed during the edging process, the line 138 is initially consumed, the second edging pass references line 141, the third edging pass utilizes line 144, and finally the only reference line remaining for use is the line 147.

Three pairs of vertical linear markings are formed on calibration lens 110. The outermost pair of vertical linear markings is composed of lines 150 and 151, separated by a distance 152 of approximately 1.969 inch. The lines 150 and 151 extend vertically so as to terminate at the perimeter 154 of the lens 110, where they join the horizontal lines 138 and 139. A second pair of vertical linear markings includes vertical lines 153 and 155, each of which terminates at the horizontal lines 141 and 142. The spacing 156 between lines 153 and 155 is approximately 1.732 inch. A third pair of vertical linear markings consists of vertical lines 157 and 158, which each have a lower end that is spaced a distance 159 of approximately 0.398 inch from the horizontal axis 112.

The upper ends of the lines 157 and 158 reside at a distance 160 from the horizontal axis 112 of approximately 1.043 inch. The parallel vertical lines 157 and 158 are spaced apart from each other by a distance 161 of approximately 1.335 inch. As best seen in FIG. 18, the outer radius 162 of the lens 110 is approximately 3.497 inches, the lens 110 having a thickness 163 of approximately 0.087 inch. The overall distance 166 between the top surface 164 and the bottom surface 165 is approximately 2.812 inches. The central region of the calibration lens 110 is best viewed in FIG. 26, which includes a tee 167 which is formed to have a horizontal section 168 that has a length 169 of approximately 0.158 inch. The lower tip 170 of tee 167 is spaced apart from the horizontal axis 112 by a distance 171 of approximately 0.039 inch. Horizontal section 168 is displaced from the horizontal axis 112 by a distance 172 of approximately 0.157 inch. A pair of horizontal linear markings 174 and 175 overlay the horizontal axis 112. The end 176 of the horizontal marking 174 is offset from the vertical axis 111 by a distance 173 of approximately 0.039 inch.

The vertical and horizontal lines just described define rectangles that replicate two types of machine calibration standards commonly used in the spectacle lens industry. The first calibration standard is used in association with equipment manufactured by National Optronics, 100 Avon Street, Charlottesville, Va., while the second standard is a development of Precision Tool Technologies, 924 Wright Street, Brainerd, Minn.

Figure 27:
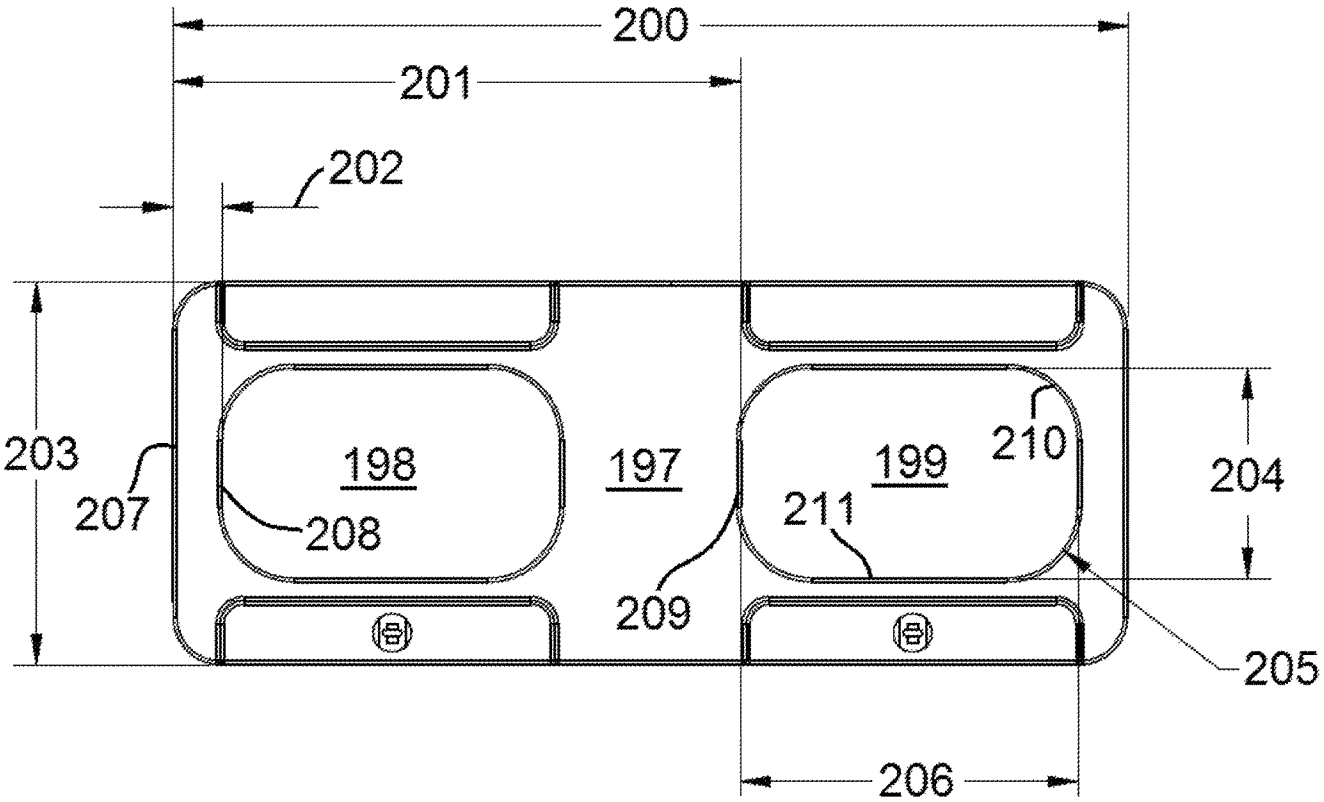
FIG. 27 is a front elevation view illustrating a calibration standard used in conjunction with the present invention.

FIG. 27 depicts an example of a machine calibration standard device 197, which is formed to include two exemplary lens shape cutouts or pockets 198 and 199 having a specific geometry and dimensions. The overall width 200 of the standard device 197 is approximately five inches, while the overall height 203 is approximately two inches. The distance 201 between the left edge 207 of the standard device and the left edge 209 of lens pocket 199 is approximately 2.972 inches. The distance 202 between left edge 207 and the left edge 208 of the lens pocket 198 is approximately 0.261 inch. The height 204 of the lens pocket 199 is approximately 1.0977 inches, while the width 206 of the lens pocket 199 is approximately 1.767 inches. The radius 205 of each corner 210 is approximately 0.375 inch.

The geometry and dimensions of each lens pocket 198 and 199 are identical. Each lens pocket defines an internal circumference 211 which extends continuously around each pocket 198 and 199. In practice, a stylus, feeler gauge or other sensor travels along the circumference 211 to define the shape and size of a lens which is to be formed by a cutting or edging device associated with the sensor. In this manner the particular geometry of the pocket 198, for example, is transferred to the edging device and is typically accessible to an operator of the edging device via a graphical user interface or other convenient means. The machine operator is then free to generate a drawing or display which indicates the desired configuration of a finished lens which may then be compared to the lens blank 98.

Figure 28:
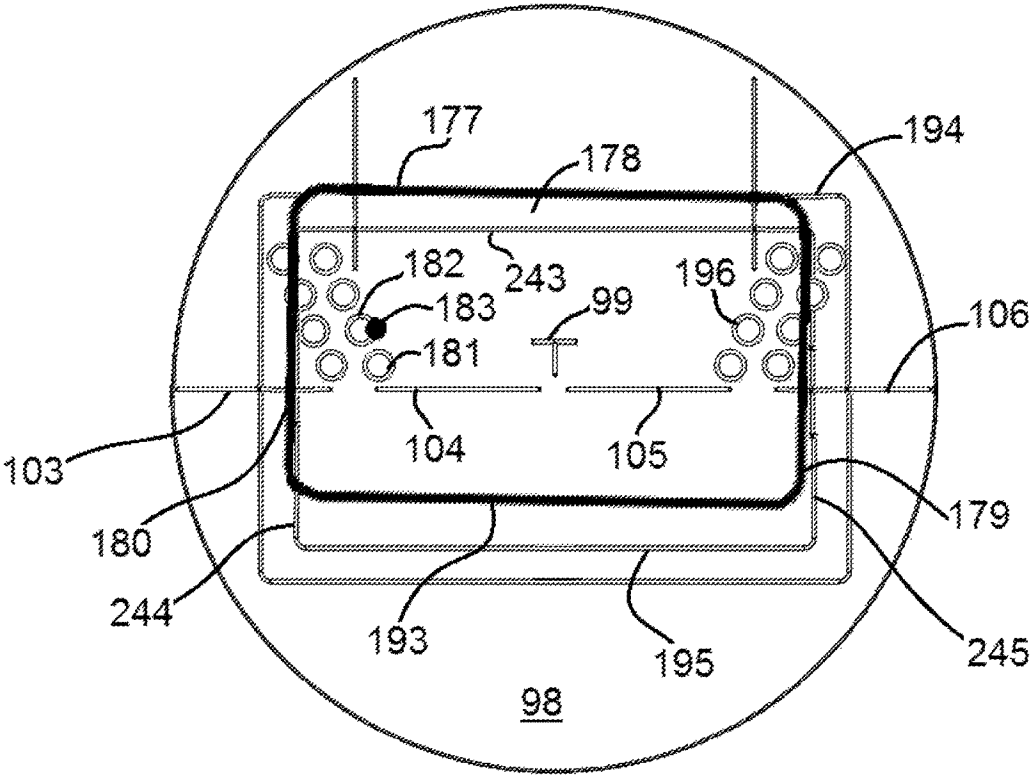
FIG. 28 is a front elevation view illustrating the utilization of a first calibration lens constructed according to the present invention, showing the portion of the calibration lens that remains after the calibration lens has undergone machining operations.

FIG. 28 illustrates the use of the lens blank 98 that is depicted in FIG. 23. A lens 178 is shown that results from an edging process performed on the blank 98. In other words, only the lens 178 remains after machining blank 98, so all of the material residing outside of the closed boundary defined by lines 177, 180, 193 and 179 would no longer be present. Although a substantial portion of the surface area of the blank 98 has been discarded, the remaining data present regarding the quality of the lens 178 is sufficient to indicate a miscalibration of the edging tool. The horizontal lines 194 and 195 are no longer present, but the horizontal line segments 104, 105 and 243 remain and are sufficient to readily indicate that the lens 178 is tilted with respect to the horizontal axis of the lens blank 98. While only a portion of the horizontal line segment 103 is present on the lens 178, a somewhat smaller part of the symmetrically positioned line segment 106 is visible. Vertical line 244 is slightly visible, while vertical line is not visible. This geometry indicates that lens 178 is off center. A hole 183 has been drilled in the lens 178, but overlaps the circular marking 182, indicating that the hole 183 has not been drilled in its desired location. The symmetrically placed circular marking 196 does not show any sign of a drilling operation, further indicating a substantial misalignment of the edging machine that performed the machining operations on the blank 98.

Figure 29:
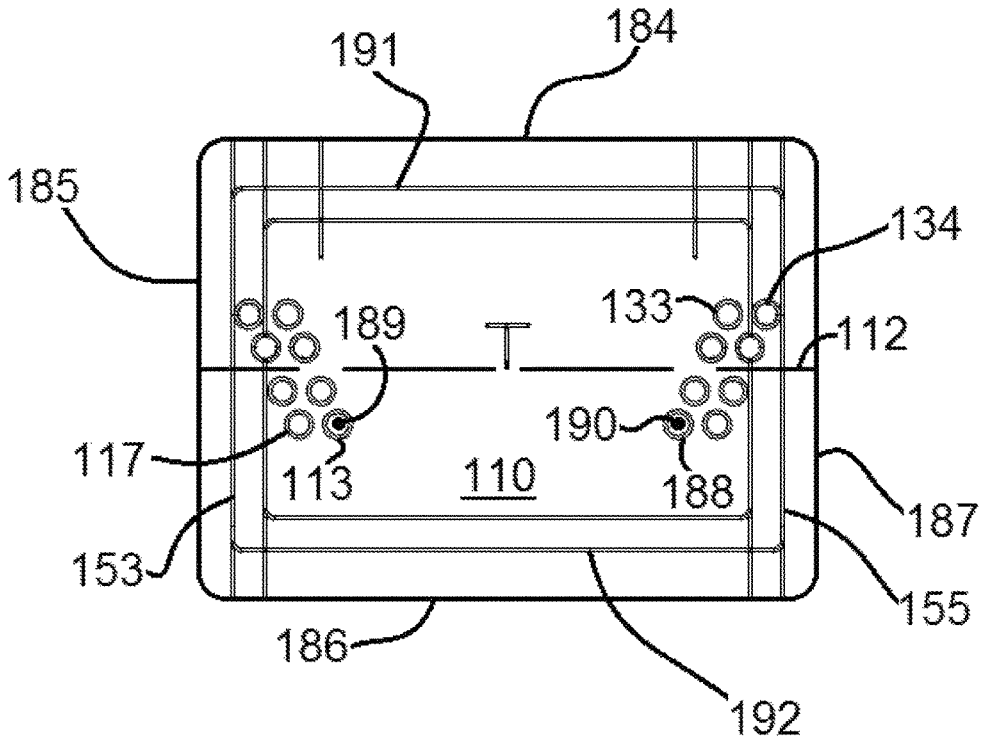
FIG. 29 is a front elevation view illustrating the utilization of a second calibration lens constructed according to the principles of the present invention, showing only the portion of the calibration lens that remains after the lens has undergone desired machining operations.

Referring also to FIG. 29, the lens blank 110 illustrated in FIG. 24 is shown after being formed into a completed lens. In other words, the portion of blank 110 appearing in FIG. 24 but absent in FIG. 29 has been removed during the machining operation that formed the completed lens. The proper formation of the lens is apparent by observing that the vertical marking 153 is parallel to lens edge 185, while lens edge 187 is parallel to vertical marking 155. Similarly, horizontal lens edges 184 and 186 are parallel to horizontal markings 191 and 192. The drilling operations also appear to be correct based on the presence of drilled bore 189 residing entirely within the circular marking 113. A corresponding bore 190 appears within the boundary defined by the symmetrically spaced circular marking 188. These correlations indicate that the edging device that removed material from the lens blank 110 has been properly calibrated and is performing as desired.

The foregoing features embodied in the present invention are by way of example only. Those skilled in the lens manufacturing field will appreciate that the foregoing features may be modified as appropriate for various specific applications without departing from the scope of the claims. For example, the dimensions and shape of the collet 22 may be varied to accommodate a particular deblocking machine. Further, the position and number of blades 65 and 66 may be adjusted to accommodate a particular edging block 40. Further, the calibration lenses 98 and 110 may have different shapes and dimensions that those depicted, and the surface markings may be varied as required for a particular lens design.

I claim:

1. A method f calibrating a lens machining device, comprising the steps of:

(a) preforming a plurality of standardized calibration lenses each lens being substantially identical and containing substantially all information corresponding to characteristics of a completed properly machined lens;

(b) pre-applying at least three pairs of parallel vertical linear markings to each of the substantially identical calibration lenses so as to parallel a vertical axis of each standardized calibration lens;

(c) pre-applying sixteen circular markings to each of the substantially identical calibration lenses in a pattern with respect to a horizontal axis and a vertical axis so as to include substantially all possible bore locations to be placed on a completed lens, the pattern comprising:

(i) a first set of circular markings pre-applied to each of the substantially identical calibration lenses in a substantially horizontal direction so as to form a first substantially horizontal row of circular markings on a first side of a horizontal axis of the calibration lens;

(ii) a second set of circular markings pre-applied to the calibration lens in a substantially horizontal direction so as to form a second substantially horizontal row of circular markings on a second side of a horizontal axis of the calibration lens;

(iii) horizontally offsetting the first set of circular markings from the second set of circular markings so as to form a diagonal row of circular markings that extends from the first side of the horizontal axis to the second side of the horizontal axis;

(d) pre-applying a third set of circular markings to each of the substantially identical calibration lenses, the third set of circular markings being a mirror image of the first and second set of circular markings;

(e) machining one of the substantially identical calibration lenses with the lens machining device;

(f) comparing a selected portion of the information on the calibration lens with markings on the calibration lens attributable to the lens machining device; and (g) comparing vertically oriented features of the machined calibration lens attributable to the lens machining device with the plurality of additional linear vertical marks remaining on the calibration lens after machining of the calibration lens is completed.

* * * * *